US008303434B1

(12) United States Patent
DePaul

(10) Patent No.: US 8,303,434 B1
(45) Date of Patent: Nov. 6, 2012

(54) PUTTER TYPE GOLF CLUB

(76) Inventor: Richard DePaul, Whitestone, NY (US)

( * ) Notice: Subject to any disclaimer, the term of this patent is extended or adjusted under 35 U.S.C. 154(b) by 324 days.

(21) Appl. No.: 12/803,264

(22) Filed: Jun. 23, 2010

(51) Int. Cl.
*A63B 53/04* (2006.01)

(52) U.S. Cl. ..... 473/341; 473/255

(58) Field of Classification Search ..... 473/340, 473/341, 251–255, 334–337
See application file for complete search history.

(56) References Cited

U.S. PATENT DOCUMENTS

| | | | | | |
|---|---|---|---|---|---|
| D137,064 | S | * | 1/1944 | Roberts | D21/726 |
| D229,844 | S | * | 1/1974 | Pavelle | D21/741 |
| D234,962 | S | | 4/1975 | Swash | D34/5 GH |
| 3,921,984 | A | * | 11/1975 | Winter | 473/251 |
| D359,330 | S | * | 6/1995 | Channell | D21/741 |
| D381,382 | S | * | 7/1997 | Fenton, Jr. | D21/743 |
| D399,274 | S | * | 10/1998 | Bradford | D21/736 |
| D422,041 | S | * | 3/2000 | Bradford | D21/736 |
| 6,652,390 | B2 | * | 11/2003 | Bradford | 473/341 |
| 6,752,723 | B2 | | 6/2004 | Cullen | 473/251 |
| D515,156 | S | | 2/2006 | Garcia | D21/746 |
| 7,018,304 | B2 | * | 3/2006 | Bradford | 473/334 |
| D532,846 | S | * | 11/2006 | Lee et al. | D21/736 |
| D537,137 | S | | 2/2007 | Sheehan | D21/746 |
| 7,201,668 | B1 | * | 4/2007 | Pamias | 473/288 |
| D542,869 | S | | 5/2007 | Adams | D21/742 |
| D551,310 | S | * | 9/2007 | Kuan et al. | D21/759 |
| 7,297,073 | B2 | * | 11/2007 | Jung | 473/340 |
| 7,326,121 | B2 | | 2/2008 | Roake | 473/251 |
| 7,431,660 | B2 | * | 10/2008 | Hasegawa | 473/251 |
| 7,431,663 | B2 | * | 10/2008 | Pamias | 473/288 |
| D582,497 | S | | 12/2008 | Rollinson | D21/744 |
| D585,510 | S | | 1/2009 | Murrieta | D21/736 |
| 7,491,131 | B2 | | 2/2009 | Vinton | 473/251 |
| D589,575 | S | * | 3/2009 | Kim et al. | D21/744 |
| D590,461 | S | * | 4/2009 | Kim et al. | D21/743 |
| D591,807 | S | * | 5/2009 | Rollinson | D21/744 |
| D595,373 | S | | 6/2009 | Kim et al. | D21/744 |
| D604,787 | S | * | 11/2009 | Hopkins | D21/791 |
| D619,666 | S | * | 7/2010 | DePaul | D21/743 |
| D621,458 | S | * | 8/2010 | Serrano et al. | D21/736 |
| D636,830 | S | * | 4/2011 | Cardani | D21/759 |
| 7,922,603 | B2 | * | 4/2011 | Boyd et al. | 473/334 |
| 2009/0305813 | A1 | * | 12/2009 | Campadore et al. | 473/340 |

* cited by examiner

*Primary Examiner* — Stephen L. Blau
(74) *Attorney, Agent, or Firm* — Goldstein Law Offices, P.C.

(57) ABSTRACT

A putter golf club that resists twisting by increasing the rotational inertia of the golf club to the maximum degree possible by distributing mass away from the center of mass of the putter, and thereby expands the sweet spot of the putter. Rotational inertia is maximized via use of a heel control wing and a toe control wing extending rearwardly and outwardly from a striking face of the putter as well as a tail rod extending perpendicularly from striking face. Further increase of rotational inertia is accomplished via s symmetrical recesses incorporated into heel and toe control wing.

5 Claims, 5 Drawing Sheets

PUTTER TYPE GOLF CLUB

CROSS REFERENCES AND RELATED SUBJECT MATTER

This application relates to subject matter contained in patent application Ser. No. 29/315,270, filed in the United States Patent Office on Jun. 10, 2009.

BACKGROUND OF THE INVENTION

The invention relates to a putter golf club. More particularly, it relates to a putter golf club where mass has been distributed away from the putter's horizontal center of mass to aid in resisting unintended rotation when a putt is made and thereby facilitate making straight putts.

Putting is an under-appreciated art in the world of golf. As a result, many golfers put more thought into the selection of their drivers and irons than the selection of their putters. Despite this, on average more than 40% of all golf shots are putts, and it is undeniable that efficient putting is essential to a good game of golf.

In the physics of golf putting, in order to putt a golf ball in the most straight and therefore predictable manner it is necessary for a golf ball to be contacted by the portion of a putter known as its sweet spot.

The sweet spot appears on a putter's striking face. The striking face is the portion of the putter where contact with a golf ball is made when putting. Particularly, the sweet spot appears on the portion of the striking face in front of the putter's horizontal center of mass. Frequently, putters are designed to have a sweet spot at a midway point on the striking face between a heel and toe section of a putter. For reference, the heel of a putter is the part of the club pointing closer to the golfer and the toe is the section farther away from the golfer. When a golf ball is struck with the putter's sweet spot it will generally travel in a relatively straight line.

In practice, many golfers do not hit a golf ball consistently on the portion of the striking face in front of its horizontal center of mass. If a golfer strikes a putt off of this area the golf ball has a tendency to not travel in a straight line, thus making the putt unpredictable and less likely to sink. If the heel of a striking face hits the golf ball first, the face of the golf club will rotate closed, or towards the person making the putt. In such circumstances the golf ball will not travel in its intended straight course but rather in a direction consistent with the striking face's rotation. The opposite is true if the toe-side of the striking face hits the ball first. A large sweet spot on a putter can compensate for this by allowing putts to be made close to if not exactly on the putter's horizontal center of mass and remain accurate.

Similarly, many golfers accidently impart twist into their putters when putting. Slight twist imparted by the hands or body of the golfer causes the toe or heel of the striking face to contact a golf ball first, again leading to an unpredictable shot.

Understanding these actions aids in understanding the advantages of the present invention. Physics controls the operation of putters which, like all matter, obey Newton's Laws. According to Newton's First Law an object at rest tends to stay at rest in a linear or rotational fashion unless acted upon by an outside force. A slight rotational force imparted to the putter's striking face by rotation of the golfer's hands when making a shot or by striking a golf ball off a putter's sweet spot will cause the heel or toe of a putter to strike the golf ball first, leading to a poor and probably missed shot.

Increasing rotational inertia of a putter serves, in line with the physics of the application, to make a putter that is more resistant to twisting. Rotational inertia is a measure of an object's resistance to twisting. Increasing rotational inertia of a putter serves to create a club with the largest possible sweet spot or area on the striking face where a golf ball struck from there will travel in a straight course and not deviate due to twisting of the striking face. As a result, many golf professionals consider rotational inertia to be extremely important in evaluating a club. For example, famous golf club designer Ralph Maltby in creating his Maltby Playability Factor rates how well clubs perform in the hands of different players. In his rating of putters, he considers rotational inertia to be a key factor in determining whether a putter receives a good or bad score.

While these units may be suitable for the particular purpose employed, or for general use, they would not be as suitable for the purposes of the present invention as disclosed hereafter.

SUMMARY OF THE INVENTION

It is an object of the invention to provide a putter that maximizes rotational inertia and thereby resists twisting. Accordingly, the putter is of the general type having a shaft having a top attached to a grip as well as a bottom attached to a putter head and then has improvements as discussed hereinafter. The putter head can be subdivided into a striking face that actually strikes the golf ball when making a putt, a main body, a main body top surface, main body bottom surface, and a main body rear. The striking face has a pair of striking face lateral edges.

The invention seeks to increase the rotational inertia of the putter and resist twisting forces by extending outwardly and rearwardly from the main body a heel and toe control wing. The heel and toe control wing each have an outer edge and an inner lateral edge meeting at a wing tip located on the control wings furthest from the striking face. The outer edges of the heel and toe control wings extend from the striking face to the wing tips. The inner lateral edges of said control wings extend at angles which intersect on the main body behind the striking face. The main body top surface has a shaft connection hole substantially at the theoretical intersect of the inner lateral edges of the control wings. The shaft connection hole is used to connect the bottom of the shaft to the putter head.

It is a further object of the invention to increase the rotational inertia of the putter to a greater extent and further reduce its susceptibility to rotational forces. Accordingly in an embodiment of the invention, a cylindrical tail rod extending rearwardly from the main body rear is utilized to further increase rotational inertia. This tail rod is angled perpendicular to the striking face and between the heel and toe control wings, and is located closer to the top surface than to the bottom surface.

The putter's toe control wing, heel control wing, and tail rod maximize the amount of mass distributed as far away as possible from the horizontal center of mass to increase rotational inertia, thus making the putter more resistant to rotation and makes completing a shot easier. Just as how a figure skater turning on an axis speeds up when pulling her arms in and slows down when putting her arms out even though the total rotational energy of her body has not changed, by maximizing the amount of mass distributed away from the horizontal center of mass the putter becomes more difficult to rotate when rotational force is mistakenly inputted by the golfer's hands or by a golf ball being hit off center of the putter's face. This will add to the forgiveness of the golf club and facilitate the making of a clean putt. In effect, the invention maximizes the sweet spot of the striking face, making clean shots easier to make.

It is yet a further object of the invention to increase still the rotational inertia of the putter. Accordingly, another embodiment of the invention has matching recesses built into each control wing to further distribute mass to the outside of the putter head and away from the center of mass of the invention.

It is a further object of the invention to provide a putter that is legal for use under the United States Golfing Association Rules or any other official governing body of the sport of golf. Accordingly, along with significant innovations, the putter is configured to comply with the rules governing putters under the respective governing bodies in the field of golf.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Where used herein to refer to physical portions of the invention, the terms "heel" and "toe" with respect to the accompanying drawings, assume the invention described is used by a left-handed golfer. When used by a right-handed golfer all such descriptions will be reversed, as such terms are essentially interchangeable provided their usage remains consistent.

Figure 1:
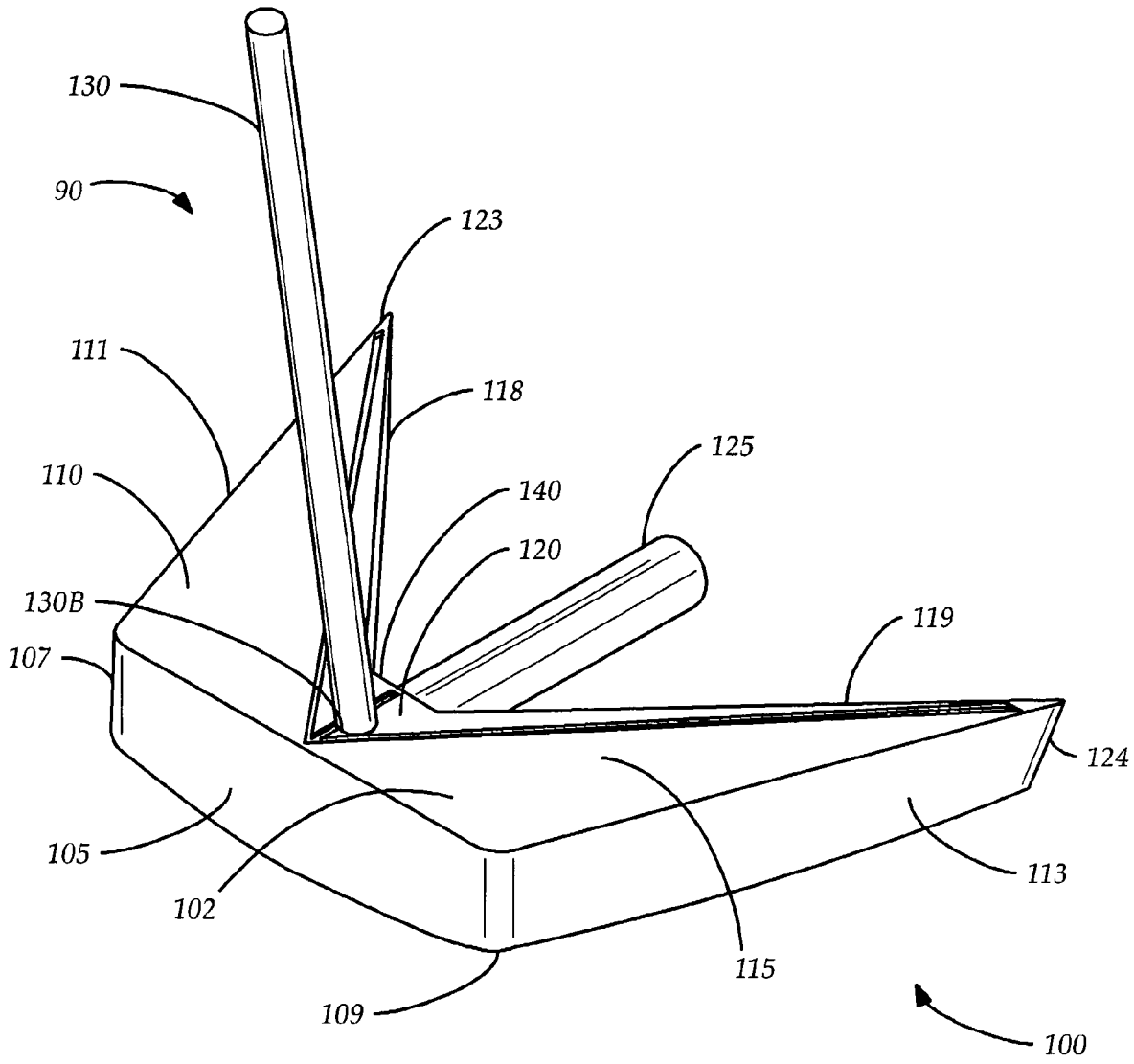
FIG. 1 is a diagrammatic perspective view of an embodiment of the invention displaying the putter head and front striking face, the main body top surface, the heel and toe control wings, the tail rod, and the shaft.

FIG. 1 illustrates a putter 90 in accordance with the principles of the present invention, having a putter head 100 and a shaft 130. The shaft 130 has a bottom 130B which is attached to the putter head 100. The putter head 100 has a shaft connection hole 120, where the bottom 130B of the shaft 130 is attached. The putter head 100 also has a main body 102, having a top surface 150, a bottom surface 151, a main body rear 140, and a front striking face 105 which is that part that actually strikes a golf ball when making a putt.

In accordance with the principles of the present invention, the putter head also has a heel control wing 110 and a toe control wing 115 extending rearwardly and outwardly from the main body 102. The striking face has a pair of striking face lateral edges 107, 109. The heel control wing 110 and toe control wing 115, extend rearwardly and outwardly from the striking face lateral edges 107, 109. In particular the heel control wing 110 has an outer edge 111 which extends rearwardly from striking face lateral edge 107, and toe control wing 115 has an outer edge 113 which extends rearwardly from striking face lateral edge 109. The heel control wing 110 and toe control wing 115 each have inner lateral edges 118, 119 which extend rearwardly from the main body rear 140. The outer edges of the heel and toe control wings meet the inner lateral edges 118, 119 at a heel wing tip 123 and a toe wing tip 124, respectively. Said heel and toe wing tips are located on the control wings 110, 115 furthest from the striking face 105. In this embodiment of the invention, a cylindrical tail rod 125 extends rearwardly from the main body rear 140, substantially perpendicular to the front striking face 105. These control wings as well as the tail rod serve to distribute the mass of the putter head away from the striking face and increase the rotational inertia of the putter and thereby make it more resistant to twisting and easier to make a putt with. In this embodiment the control wings contain more than one third of overall mass of putter head.

Figure 2:
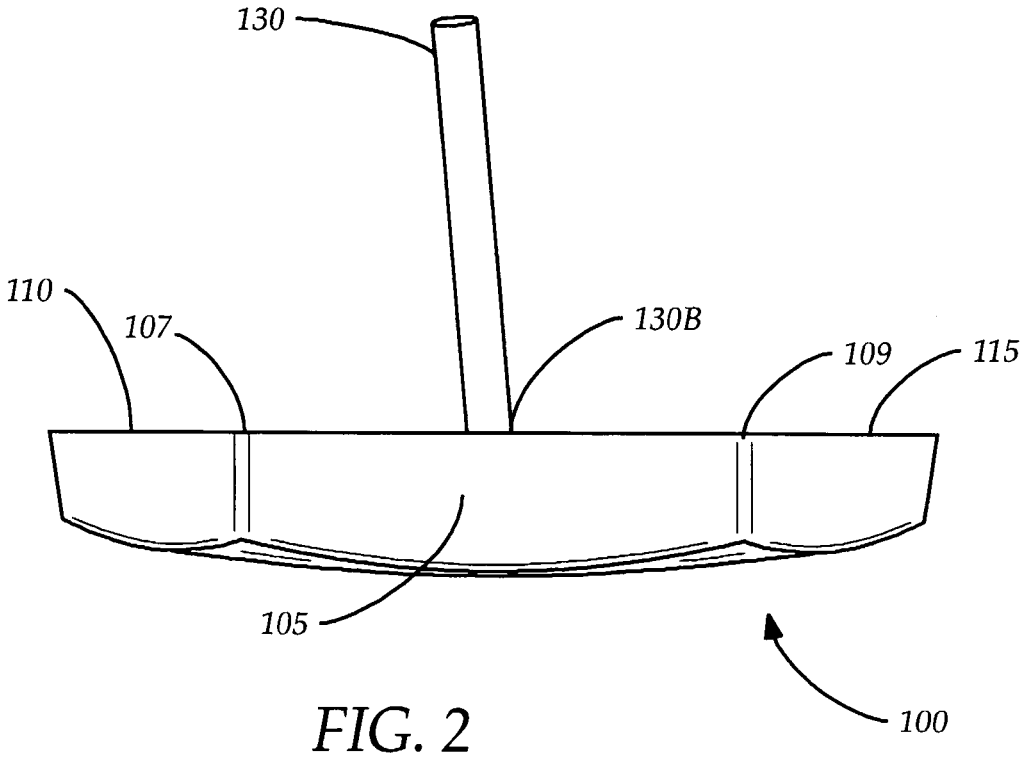
FIG. 2 is a front view of an embodiment of the invention displaying the striking face and the shaft.
Figure 3:
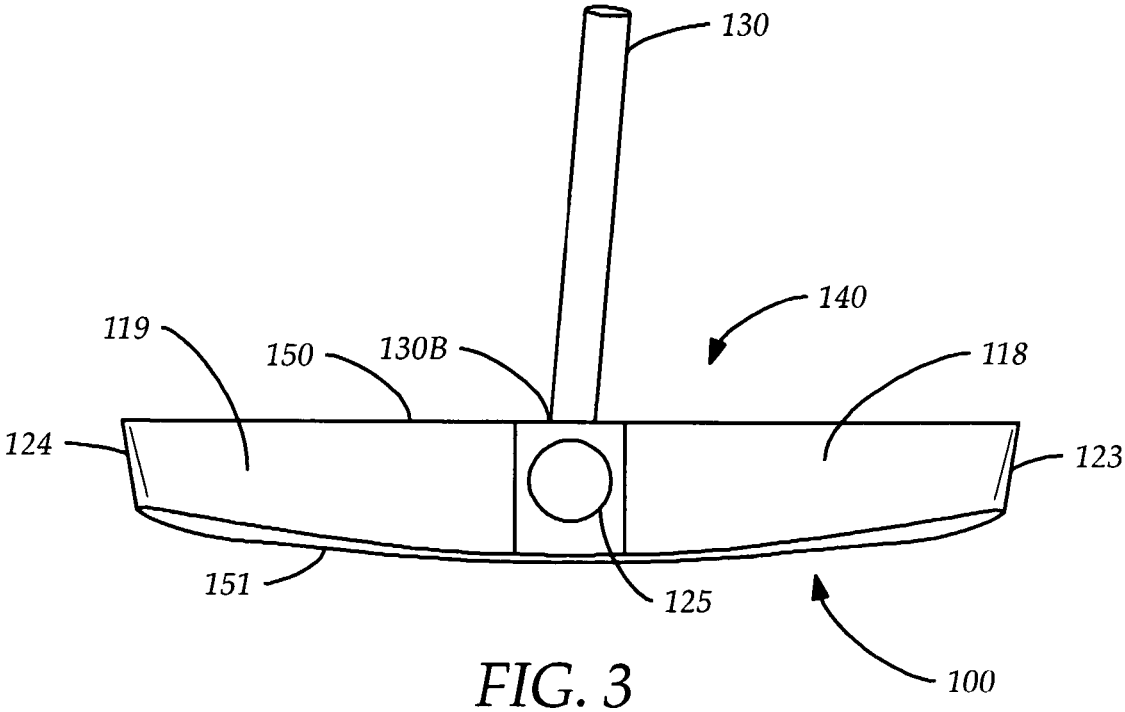
FIG. 3 is a rear view of an embodiment of the invention displaying the main body rear, tail rod, and shaft.

FIG. 2 displays a front view of the putter head 100 connected to the shaft 130 through the bottom of the shaft 130B. The bottom of the shaft 130B is attached to the putter head 100 at approximately a 70 degree angle. Extending rearwardly and outwardly from the striking face lateral edges 107, 109 are the heel and toe control wings 110, 115. FIG. 3 effectively illustrates the main body rear 140 of the putter head 100. The rear of the tail rod 125 can be seen, as well as the inner lateral edge of the heel and toe control wing 118, 119. Again, the shaft 130 can be seen extending upwardly from the bottom of the shaft 130B which attaches to putter head 100 at approximately a 70 degree angle. Note that the tail rod 125 is located closer to the top surface 150 than the bottom surface 151, which helps redistribute mass higher up on the striking face 105 to help the golf ball 'roll off the face' with some over-spin.

Figure 4:
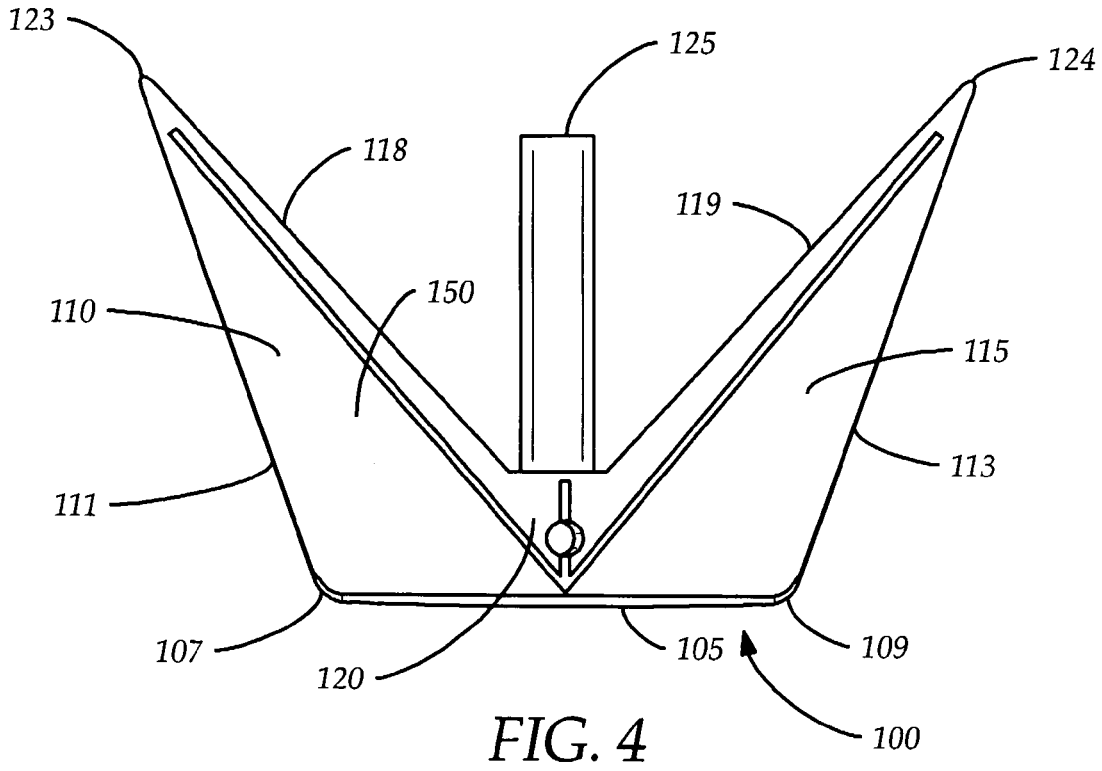
FIG. 4 is a top view of an embodiment of the invention displaying the putter head, main body top surface, the heel and toe control wings, tail rod, wherein the shaft has been removed, showing the shaft connection hole.
Figure 5:
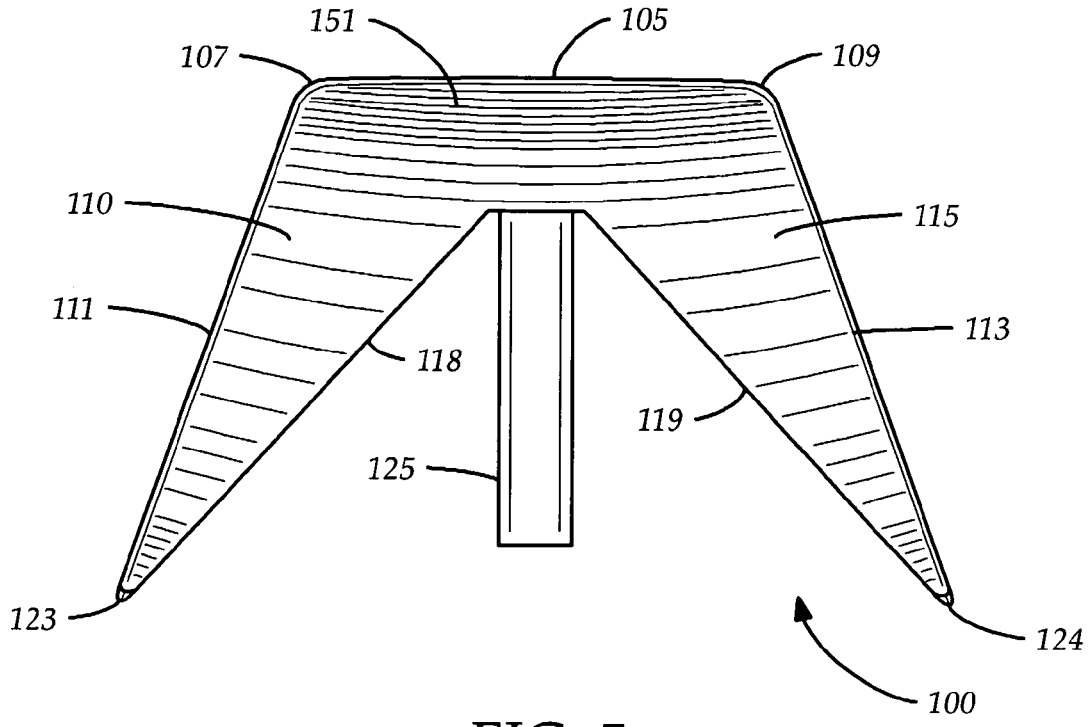
FIG. 5 is a bottom view of an embodiment of the invention.
Figure 6:
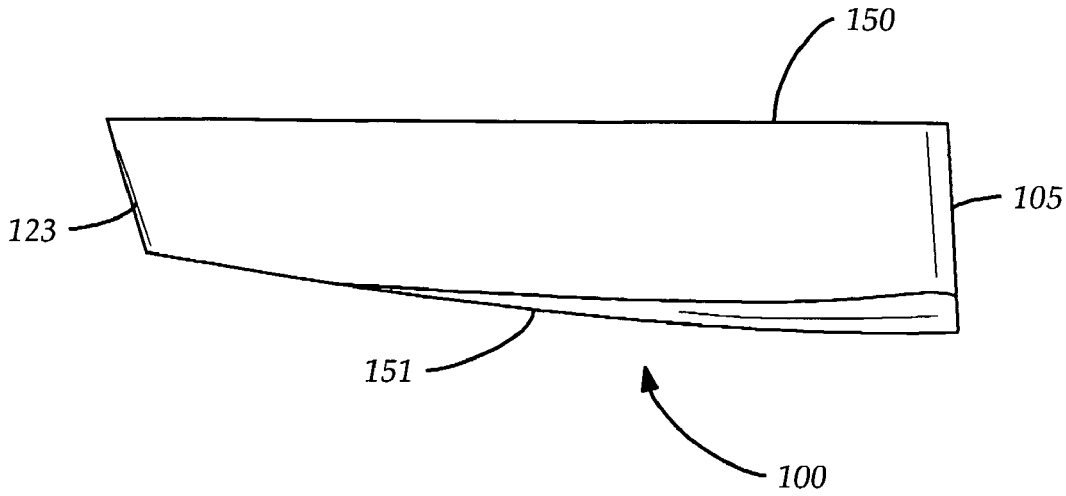
FIG. 6 is a side view of an embodiment of the invention with the striking face on the right.

FIG. 4 is a top view of the main body top surface 150 of the putter head 100. The shaft connection hole 120 can be seen. FIG. 5 is a bottom view of the main body bottom surface 151 section of the putter head 100. FIGS. 5 and 6 both display the heel and toe control wings 110, 115 extending rearwardly and outwardly from the main body 102. The heel and toe control wings have outer edges 111, 113 which extend rearwardly and outwardly from the striking face lateral edges 107, 109. The inner lateral edge 118 of heel control wing 110 meets the outer edge of heel control wing 111 at the heel wing tip 123 located on the point of the heel control wing 110 furthest from the striking face 105. The same is true for the inner lateral edge 119 of the toe control wing 115 which meets the outer edge of toe lateral control wing 113 at the toe wing tip 124, again located at the point on the control wing furthest from the striking face. The inner lateral edges meet at angles which intersect on the main body behind the striking face, which could also be considered the 'theoretical intersection' of the inner lateral edges of the control wings. The rear tail rod 125 as illustrated extends substantially perpendicularly to the striking face 105.

FIG. 6 is a side view displaying the putter head 100. The putter head 100 has a main body top surface 150 and a main body bottom surface 151. The striking face 105 in this embodiment is angled with 4 degrees of loft from the perpendicular. When making a putt the 4 degrees of loft serves to lift the golf ball slightly out of the depression the weight of the golf ball creates in the grass of the putting green and imparts a rolling action on the golf ball. Imparting a rolling action is important in making accurate shots. Heel wing tip 123 can also be seen.

Figure 7:
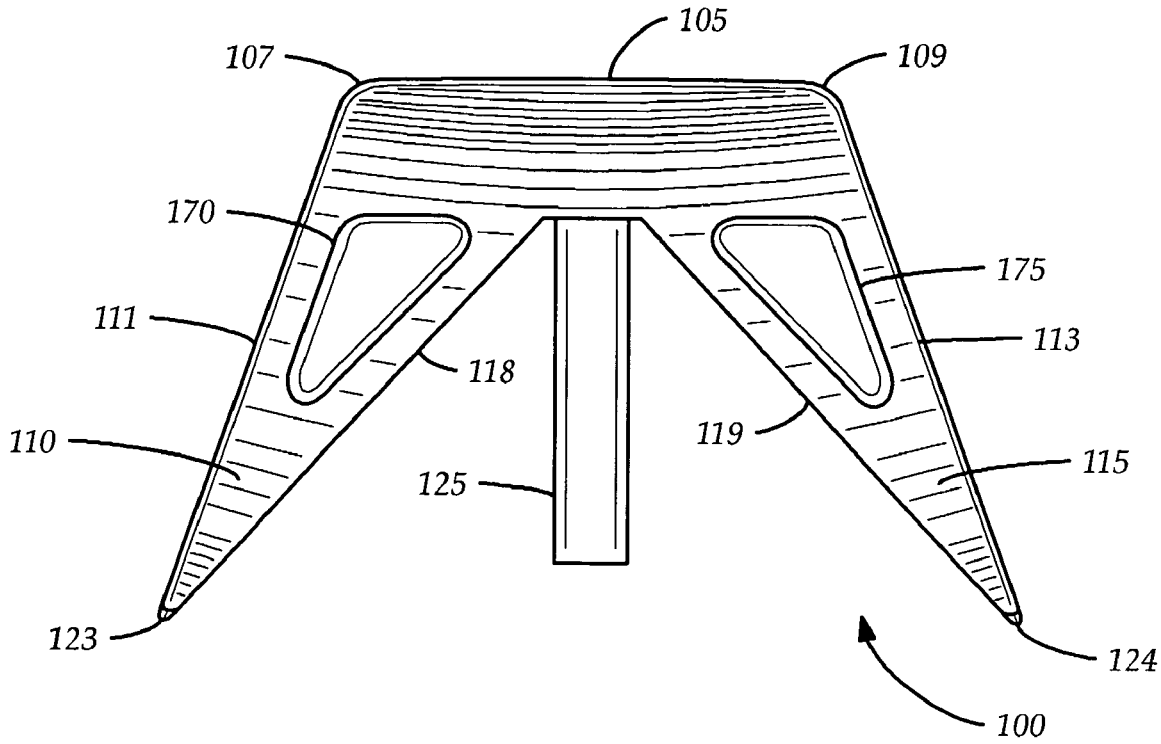
FIG. 7 is a bottom view of an embodiment of the invention displaying the putter head, main body bottom surface, the heel and toe control wings, tail rod, and further displays matching recesses extending upwardly into the heel and toe control wings.

FIG. 7 is a bottom view. This embodiment has the same elements as described before except that built into heel control wing 110 and toe control wing 115 are recesses 170, 175 extending upwardly thereinto, yet not fully to the top surface. These recesses serve to further maximize rotational inertia and further distribute mass to the outside of the putter head, and away from the center of mass of the invention.

Figure 8:
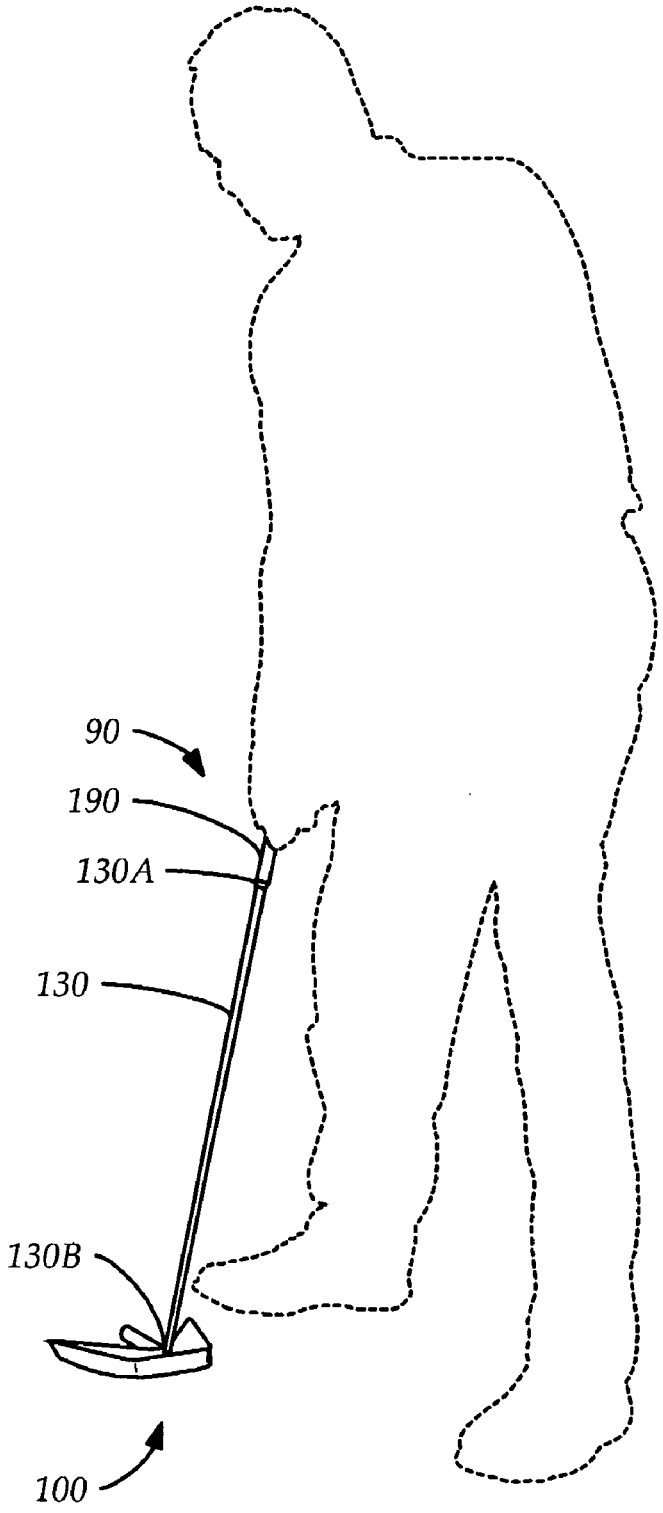
FIG. 8 is a diagrammatic perspective view illustrating a golfer addressing a golf ball using an embodiment of the invention.

FIG. 8 is a view of a golfer addressing a golf ball with the putter 90. Note—"addressing" is a term commonly used in golf to describe the posture of standing over a ball and preparing to make a shot. The putter 90 has a top section of the shaft 130A attached to a grip 190 for swinging the club 90. The bottom of the shaft 130B is attached to the putter head 100 at approximately a 70 degree angle. The posture of the golfer using the club 90 can be noted.

In conclusion, herein is presented a putter golf club. The invention is illustrated by example in the drawing figures, and throughout the written description. It should be understood that numerous variations are possible, while adhering to the inventive concept. Such variations are contemplated as being a part of the present invention.

What is claimed is:

1. A putter, for use by a golfer, when hitting a golf ball, and for maximizing rotational inertia comprising:

a shaft, having a top and a bottom, a grip located at the top;

a putter head, having a striking face having a pair of lateral edges, and having a main body having a top surface, a bottom surface, and a main body rear, the putter head further having heel and toe control wings which extend rearwardly and outwardly from the lateral edges of the striking face and from the main body rear, the heel and toe control wings containing more than one third of the overall mass of the putter head, the heel and toe control wings each having an outer edge and an inner lateral edge, the outer edge and inner lateral edge of each control wing meeting at a wing tip, the inner lateral edges each on a straight line, the straight lines when extended beyond the inner lateral edges intersect substantially at a shaft connection hole, the shaft connection hole located on the top surface of the main body substantially at said intersect on the main body, the bottom of the shaft connected in the shaft connection hole; and a tail rod extending rearwardly from the main body rear of the putter head, substantially centered between the control wings and extending substantially perpendicularly from the striking face.

2. The putter as recited in claim 1, where said tail rod is cylindrical in shape.

3. The putter as recited in claim 2, wherein the tail rod is located closer to the top surface of the main body than to the bottom surface of the main body.

4. The putter as recited in claim 1, wherein the control wings each have a bottom surface having recess openings extending upwardly thereinto and located rearwardly of the main body rear.

5. The putter as recited in claim 4, wherein said recess openings extending upwardly do not extend upwardly fully to the main body top surface.

* * * * *